US006031164A

United States Patent [19]

Murakami

[11] Patent Number: 6,031,164

[45] Date of Patent: Feb. 29, 2000

[54] MUTE ACOUSTIC STRINGED MUSICAL INSTRUMENT HAVING DAMPING BRIDGE

[75] Inventor: Kazuo Murakami, Shizuoka, Japan

[73] Assignee: Yamaha Corporation, Japan

[21] Appl. No.: 09/163,076

[22] Filed: Sep. 29, 1998

[30] Foreign Application Priority Data

Sep. 29, 1997 [JP] Japan ..... 9-263813

[51] Int. Cl.[7] ..... G10D 3/02

[52] U.S. Cl. ..... 84/294; 84/307

[58] Field of Search ..... 84/294, 307, 389, 84/310

[56] References Cited

U.S. PATENT DOCUMENTS 917,512 4/1909 Yutzy .
4,449,438 5/1984 Goldner ..... 84/310
5,347,906 9/1994 Geiger ..... 84/310 X

FOREIGN PATENT DOCUMENTS 52-150326 11/1977 Japan .
58-67388 5/1983 Japan .
5-94896 12/1993 Japan .

*Primary Examiner*—Jeffrey Donels
*Attorney, Agent, or Firm*—Ostrolenk, Faber, Gerb & Soffen, LLP

[57] ABSTRACT

A mute violin has a soundboard formed with a resonator, a neck projecting from the soundboard, a string holder attached to the other end of the soundboard, strings stretched between pegs screwed into the neck and the string holder and a damping bridge structure supported between a fingerboard attached to the neck and the string holder in a spacing relation to the soundboard, and the damping bridge structure is formed of viscoelastic polymer so that the vibrations are hardly propagated from the strings to the soundboard.

19 Claims, 8 Drawing Sheets

MUTE ACOUSTIC STRINGED MUSICAL INSTRUMENT HAVING DAMPING BRIDGE

FIELD OF THE INVENTION

This invention relates to an acoustic stringed musical instrument and, more particularly, to a mute acoustic stringed musical instrument such as, for example, a mute acoustic violin.

DESCRIPTION OF THE RELATED ART

An acoustic violin generates loud sound, and a violinist feels a practice sometimes difficult. There are two approaches to reduce the sound. The first approach is to replace the soundboard defining a resonator with a rigid board. In this instance, a pickup is provided on the rigid board, and converts vibrations of the strings to an electric signal. The electric signal is amplified, and, thereafter, is supplied to a head-phone so as to produce the electric sound. The second approach is to reduce the vibrations propagated from the strings to the resonator. The reduction of vibrations is achieved by a mute 1 shown in FIGS. 1 and 2. Strings 2 are stretched over a soundboard 3 and a fingerboard, and a bridge 4 is provided on the soundboard. Though not shown in FIGS. 1 and 2, pegs (not shown) and a string holder (not shown) exert appropriate tension on the strings 2 in cooperation with the bridge 4. The mute 1 is formed of rubber, and is pressed against the strings 2 as indicated by arrow AR1. When a violinist bows the acoustic violin, the strings 2 vibrates. The bridge 4 propagates the vibrations to the soundboard, and the resonator amplifies the aerial vibrations in the resonator. While the strings 2 are vibrating, the mute 1 takes up part of the vibration energy, and reduces the amplitude of the vibrations. For this reason, the acoustic violin merely generates the sounds at small loudness.

Although the first approach drastically decreases the loudness, the electric sounds are felt different from the acoustic violin sounds, because any resonator participates the generation of the electric sounds. Moreover, the violinist feels the rigid body strange.

On the other hand, the second approach is desirable in view of the timbre and the tactual sense, because the acoustic violin is used. However, even though the mute 1 restricts the vibrations of the strings 2, the bridge 4 propagates the vibrations directly to the resonator, and the sounds are fairly loud. Thus, there is a trade-off between the first approach and the second approach.

SUMMARY OF THE INVENTION

It is therefore an important object of the present invention to provide a mute stringed musical instrument, which effectively decreases the loudness without sacrifice of the timbre and the tactual sense.

To accomplish the object, the present invention proposes to impart damping characteristics to a bridge structure.

In accordance with one aspect of the present invention, there is provided a mute stringed musical instrument comprising an acoustic stringed musical instrument including a body formed with a resonator for increasing a loudness of an acoustic sound and at least one vibratory string stretched over the body so that a player presses the at least one vibratory string against the body for changing a pitch of the acoustic sound and a damping bridge structure provided between the body and the at least one vibratory string and having damping characteristics for decreasing an amplitude of vibrations during propagation of the vibrations from the at least one vibratory string to the body.

BRIEF DESCRIPTION OF THE DRAWINGS

The features and advantages of the mute stringed musical instrument will be more clearly understood from the following description taken in conjunction with the accompanying drawings in which.

DESCRIPTION OF THE PREFERRED EMBODIMENTS

First Embodiment

Figure 1:
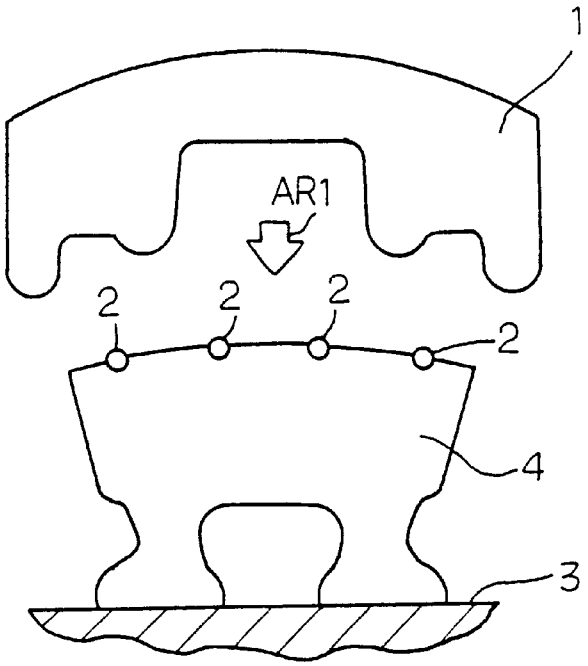
Fig. 1 PRIOR ART
FIG. 1 is a front view showing the prior art mute used for the acoustic violin.
Figure 2:
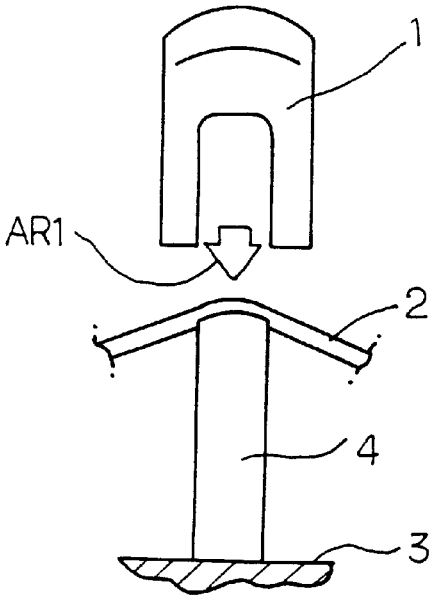
Fig. 2 PRIOR ART
FIG. 2 is a side view showing the prior art mute.
Figure 3:
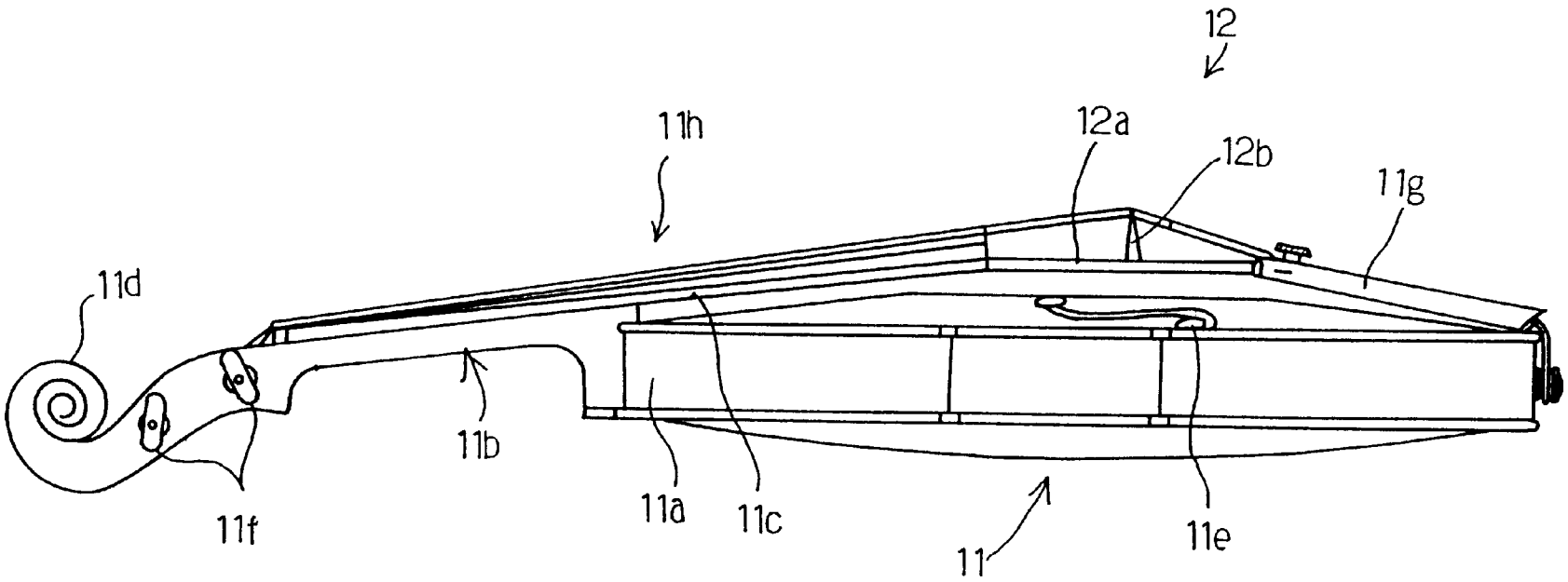
FIG. 3 is a side view showing a mute violin according to the present invention.

Referring to FIG. 3 of the drawings, a mute violin embodying the present invention largely comprises an acoustic violin 11 and a damping bridge structure 12. The bridge of the acoustic violin 11 is replaced with the damping bridge structure 12, and the damping bridge structure 12 merely propagates an extremely small amount of vibrations therethrough as will be described hereinlater.

The acoustic violin 11 includes a soundboard 11*a*, a neck 11*b* projecting from the soundboard 11*a* and a fingerboard 11*c* attached to the upper surface of the neck 11*b*. The neck 11*b* has a scroll 11*d*. In the following description, a relative position closer to the scroll 11*b* than another relative position is called as "front" position or "front" portion, and the relative position farther from the scroll 11*d* than the front position is called as "rear" position or "rear" portion. The neck 11*b* is attached at the rear position thereof to the front portion of the soundboard 1, and a front portion of the fingerboard 11*c* is held in contact with the upper surface of the neck 11*b*. The rear portion of the fingerboard 11*c* rearwardly projects from the rear end of the neck 11*b*, and extends over the soundboard 11*a*. A hollow space (not shown) is formed in the soundboard 11*a*, and is open to the air through sound holes 11*e*. The hollow space serves as a resonator.

The acoustic violin 11 further includes four pegs 11*f*, a string holder 11*g* and four strings 11*h*. The pegs 11*f* are rotatably supported by a front portion of the neck 11*b*, and the string holder 11*g* is attached to a rear portion of the soundboard 11*a*. The damping bridge structure 12 is located between the rear end of the fingerboard 11*c* and the front end of the string holder 11*g*. The strings 11*h* are anchored at the string holder 11*g* and the pegs 11*f*, and are stretched between the string holder 11*g* and the associated pegs 11*f*. A violinist rotates the pegs 11*f*, and winds the strings 11*h* thereon. The strings 11*h* are pressed against the damping bridge structure 12, and have appropriate tensions, respectively. The strings 11*h* are spaced from the rear portion of the fingerboard 11*c*. Thus, the acoustic violin 11 is a kind of standard acoustic violin except for the damping bridge structure 12.

Figure 4:
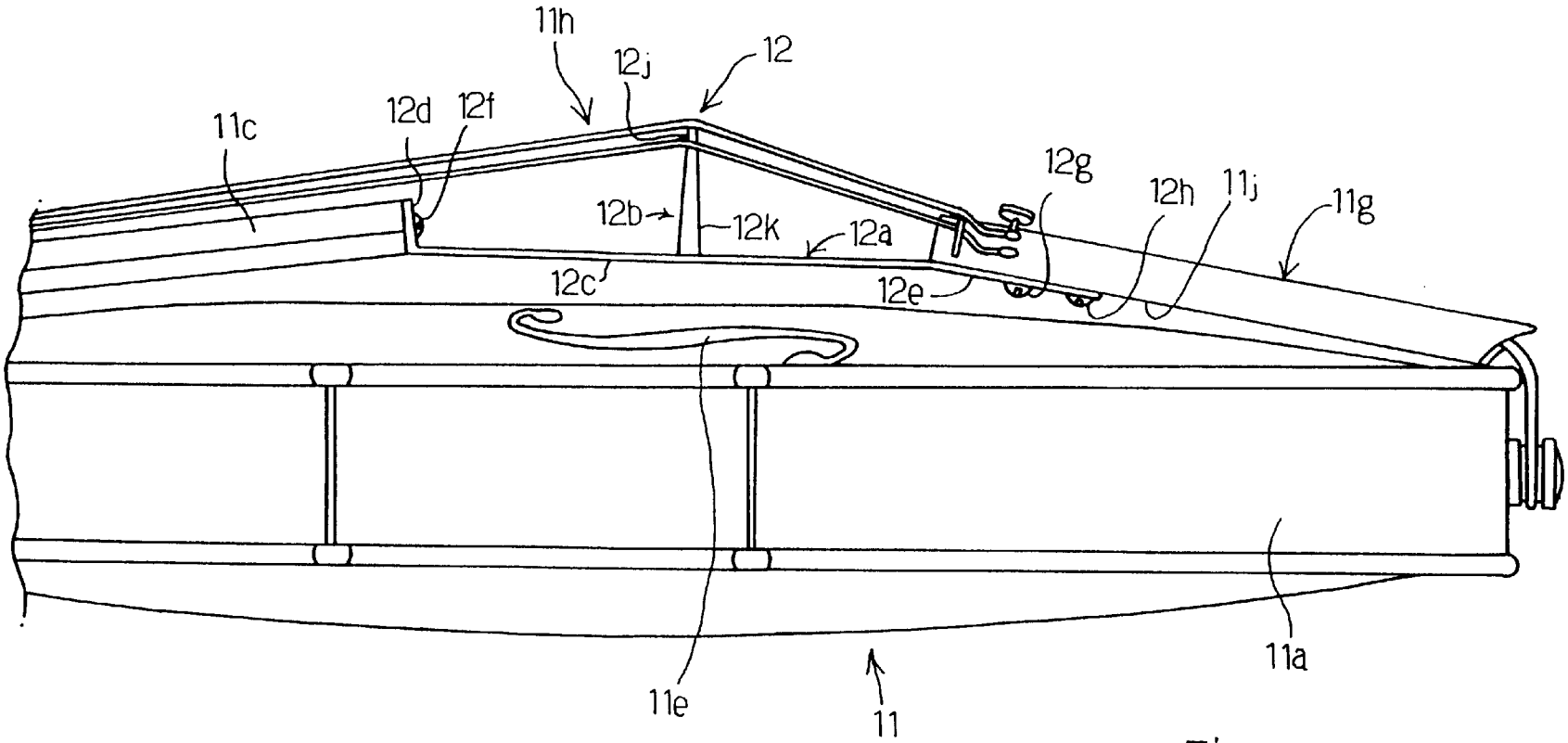
FIG. 4 is a side view showing a damping bridge structure incorporated in the mute violin.

FIG. 4 illustrates the damping bridge structure 12 in detail. The damping bridge structure 12 includes a supporting member 12*a* and a bridge 12*b*. The supporting member 12*a* is formed of material, which exhibits damping characteristics. In this instance, plural sheets of viscoelastic polymer are laminated so as to form the supporting member 12*a*. The bridge 12*b* is also formed of material exhibiting the damping characteristics. In this instance, plural thin wood plates are bonded to one another by using viscoelastic polymer. Plural viscoelastic plates may be laminated on one another.

The supporting member 12*a* has an intermediate portion 12*c* extending between the fingerboard 11*c* and the string holder 11*g*, a front end portion 12*d* bent at 100 degrees with respect to the intermediate portion 12*c* and a rear end portion 12*e* attached to the lower surface 11*j* of the string holder 11*g*. A hole (not shown) is formed in the front end portion 12*d*, and a bolt 12*f* is screwed through the hole into the rear end portion of the fingerboard 11*c*. Plural holes (not shown) are formed in the rear end portion 12*e*, and bolts 12*g*/12*h* are screwed through the holes into the string holder 11*g*. Thus, the supporting member 12*a* is fixed to the fingerboard 11*c* and the string holder 11*g*, and extends between the rear end of the fingerboard 11*c* and the front end of the string holder 11*g*.

The bridge 12*b* has an upper contact surface 12*j*, and the upper contact surface 12*j* arcs. The strings 11*h* are assigned to respective contact areas on the upper contact surface 12*j*, and are held in contact with the contact areas, respectively. The bridge 12*b* is partially bifurcated, and, accordingly, has two legs 12*k*. The two legs 12*k* are held in contact with the intermediate portion 12*c* of the supporting member 12*a*. The strings 12*h* downwardly presses the bridge 12*b* against the supporting member 12*a* due to the tensions, and the supporting member 12*a* is supported by the fingerboard 11*c* and the string holder 11*g*.

When a violinist bows the mute violin, the strings 11*h* vibrates, and the vibrations are propagated from the strings 11*h* through the damping bridge structure 12, the fingerboard 11*c* and the string holder 11*g* to the soundboard 11*a*. While the damping bridge structure 12 is propagating the vibrations to the fingerboard 11*c* and the string holder 11*g*, the bridge 12*b* and the supporting member 12*a* decreases the amplitude of the vibrations, and the amplitude on the soundboard 11*a* is close to zero. For this reason, although the soundboard 11*a* has the resonator, the mute violin merely generates faint violin sounds. The violinist bows the acoustic violin 11, and never feels the mute violin strange.

If the violinist replaces the damping bridge structure 12 with the standard bridge 4, the acoustic violin generates loud sounds. Thus, the violinist practices the acoustic violin with the damping bridge structure 12, and plays a tune with the same acoustic violin with the standard bridge 4.

Figure 5:
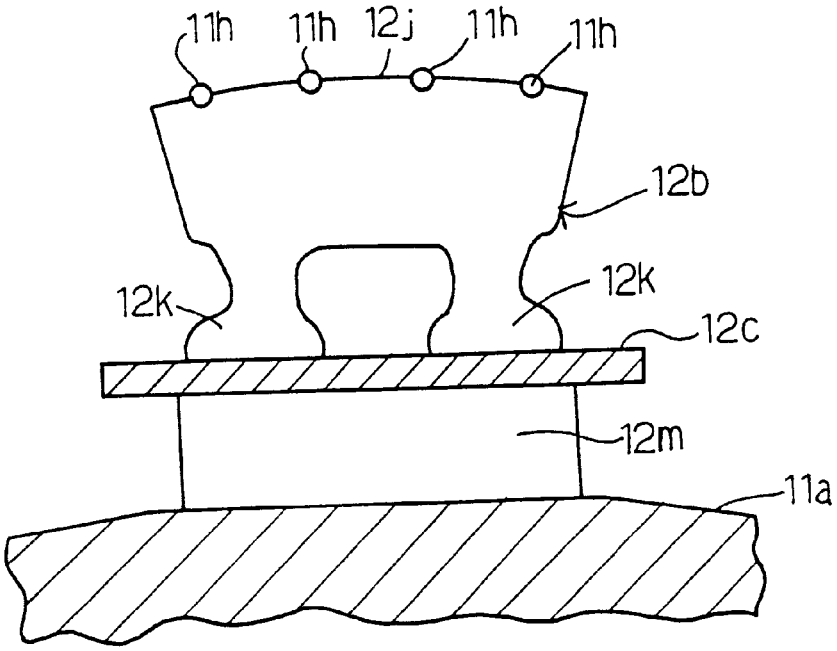
FIG. 5 is a front view showing a modification of the damping bridge structure.
Figure 6:
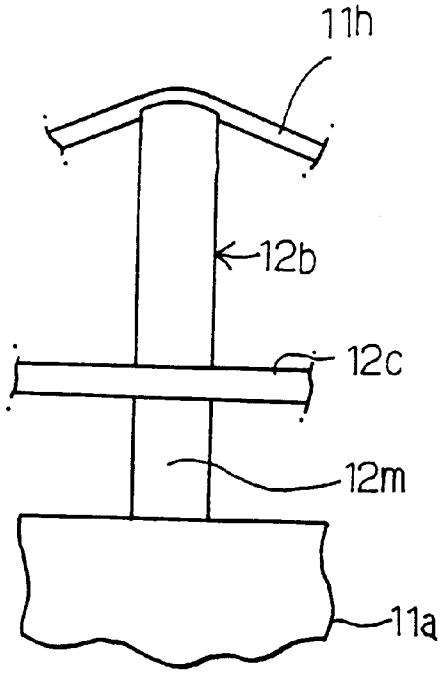
FIG. 6 is a side view showing the modification of the damping bridge structure.

The damping bridge structure 12 may further include a bypass member 12*m* as shown in FIGS. 5 and 6. The bypass member 12*m* is formed of piezoelectric polymer or nitrile rubber, and inserted between the supporting member 12*a* and the soundboard 11*a*. The bypass member 12*m* provides a bypass way from the supporting member 12*a* to the soundboard 11*a*, and modifies the timbre and the loudness of the sounds. If plural bypass members 12*m* different in damping characteristics are previously prepared, a violinist can selectively use the plural bypass members 12*m* so as to impart appropriate timbre and appropriate loudness to the sounds.

Second Embodiment

Figure 7:
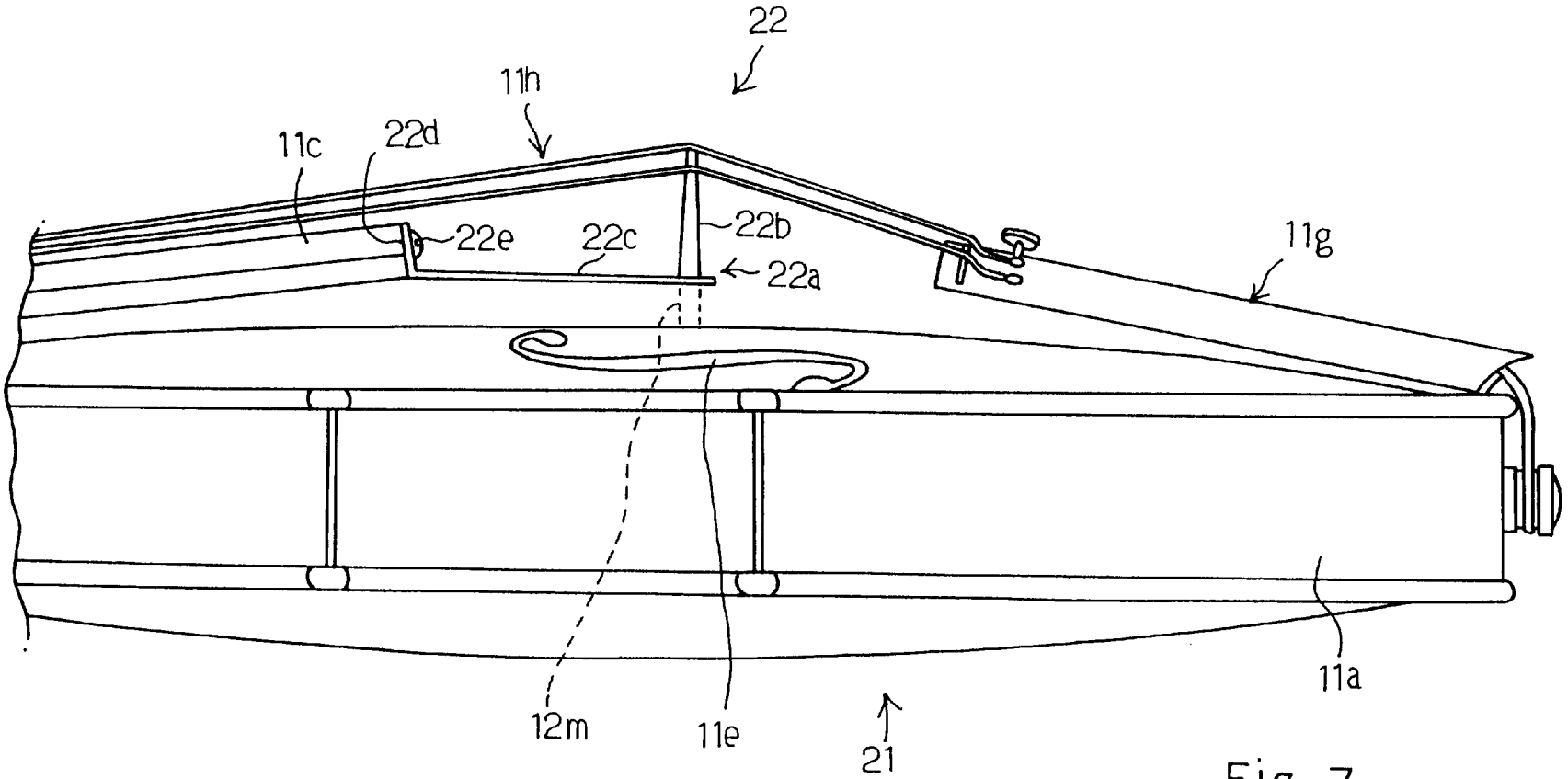
FIG. 7 is a side view showing another mute violin according to the present invention.

FIG. 7 illustrates another mute violin embodying the present invention. The mute violin implementing the second embodiment also largely comprises an acoustic violin 21 and a damping bridge structure 22. The acoustic violin 21 is similar in structure to the acoustic violin 11, and parts of the acoustic violin 21 are labeled with the same references designating corresponding parts of the acoustic violin 11 without detailed description.

The damping bridge structure 22 also includes a supporting structure 22*a* and a bridge 22*b*. The bridge 22*b* is similar to the bridge 12*b*, and no further description is incorporated hereinbelow. The supporting structure 22*a* is different from the supporting structure 12*a*. The supporting structure 22*a* is a kind of cantilever, and is divided into an intermediate portion 22*c* and a front end portion 22*d* bent at 100 degrees with respect to the intermediate portion 22*c*. A hole is formed in the front end portion 22*d*, and a bolt 22*e* is screwed through the hole into the rear end portion of the fingerboard 11*c*. The bridge 22*b* is inserted between the strings 11*h* and the supporting member 22*a*. The bridge structure 22*b* is formed of the material having the damping characteristics, and achieves all the advantages of the first embodiment. The supporting member 22*a* may have a slot so that a violinist inserts the rear end portion of the fingerboard into the slot portion. The supporting member 22*a* may be supported by the string holder 11*g*.

The damping bridge structure 22 may further include the bypass member 12*m* as similar to the first embodiment.

Third Embodiment

Figure 8:
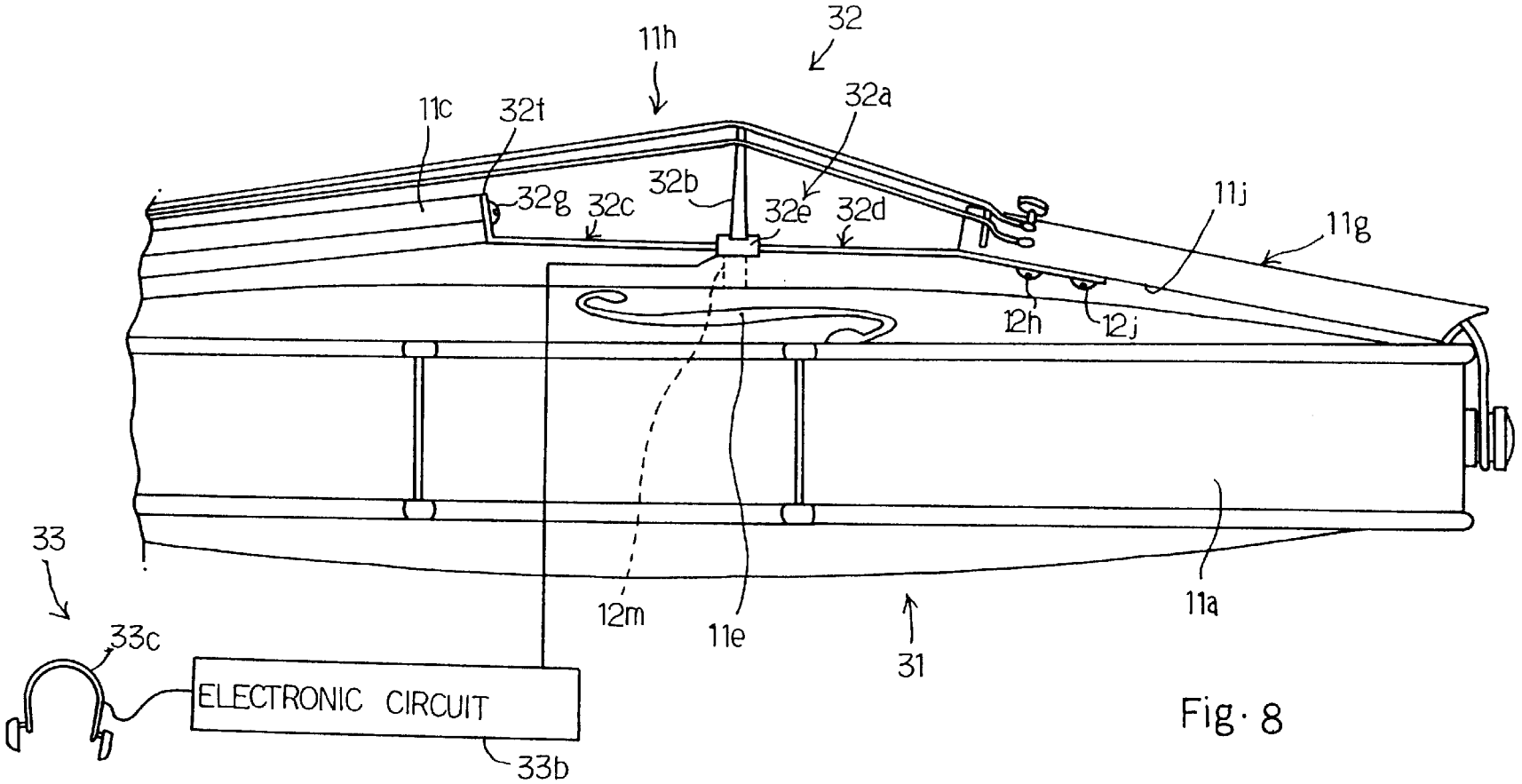
FIG. 8 is a side view showing yet another mute violin according to the present invention.

FIG. 8 illustrates yet another mute violin embodying the present invention. The mute violin implementing the third embodiment comprises an acoustic violin 31, a damping bridge structure 32 and an electronic sound generating system 33. The acoustic violin 31 is similar in structure to the acoustic violin 11, and parts of the acoustic violin 31 are labeled with the same references designating corresponding parts of the acoustic violin 11 without detailed description. The damping bridge structure 32 imparts tensions to the strings 11*h*, and decreases the amplitude of the vibrations propagated from the strings 11*h* to the soundboard 11*a*. The electronic sound generating system 33 converts the vibrations to audio signals, and produces electric sounds from the audio signals.

Figure 9:
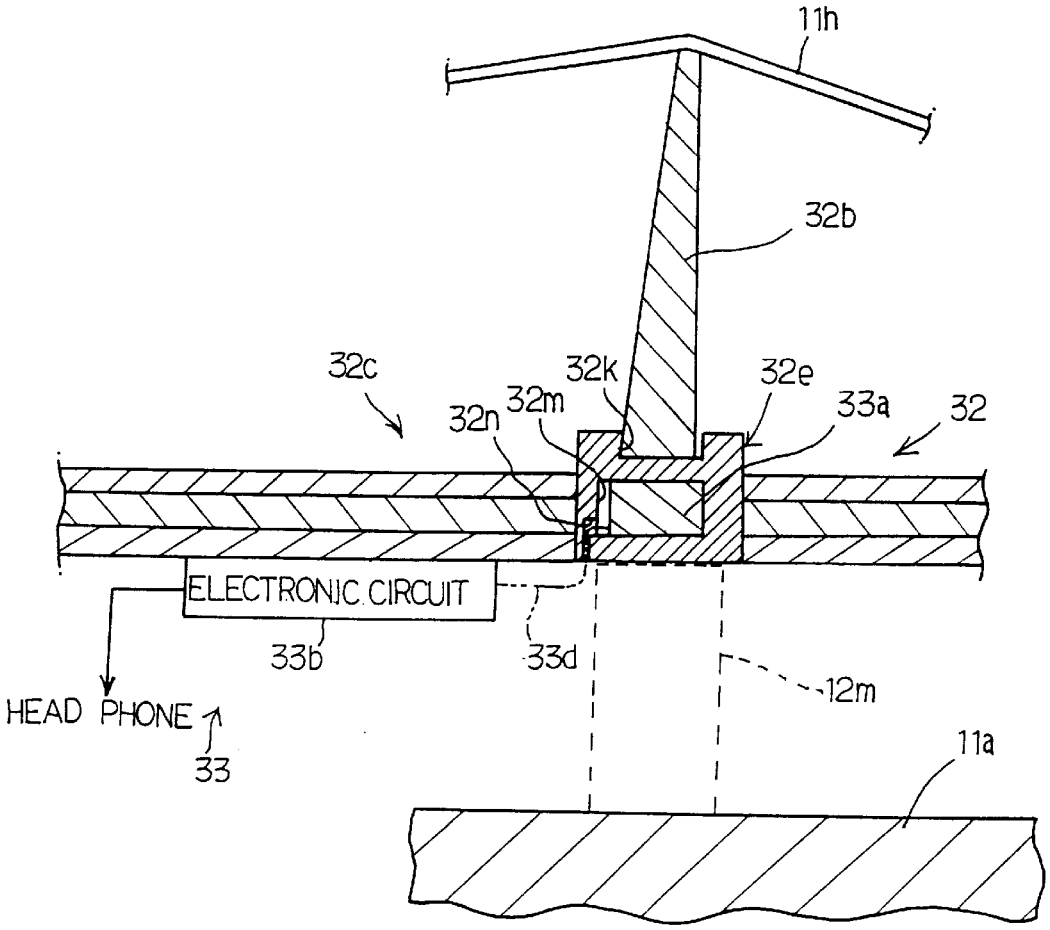
FIG. 9 is a side view showing a damping bridge structure incorporated in the mute violin.

The damping bridge structure 32 is illustrated in detail in FIG. 9, and also includes a supporting member 32*a* and a bridge 32*b*. The bridge 32*b* is similar to the bridge 12*b*, and no further description is incorporated hereinbelow.

The supporting member 32*a* includes a first cantilever 32*c*, a second cantilever 32*d* and a joint 32*e*. The first and second cantilevers 32*c*/32*d* are formed of the material similar to that of the supporting member 12*a*. The first cantilever 32*c* is bent at 100 degrees, and a hole is formed in the bent portion 32*f*. A bolt is screwed through the hole into the rear end portion of the fingerboard 11*c*. Thus, the first cantilever 32*c* is supported by the fingerboard 11*c*. The second cantilever 32*d* is partially inserted into the gap between the lower surface 11*j* of the string holder 11*g*, and bolts 12*h*/12*j* are screwed through the holes into the string holder 11*g*. Thus, the second cantilever 32*d* is supported by the string holder 11*g*. The joint 32*e* is connected between the free end of the first cantilever 32*c* and the free end of the second cantilever 32*d*. A recess 32*k* is formed in the joint 32*e*, and the bridge 32*b* is snugly received in the recess 32*k*. Thus, the bridge 32*b* is supported by the supporting member 32*a*, and imparts tensions to the strings 11*h*. A hollow space is further formed in the joint 32*k*, and is connected through a conduit 32*n* to the outer surface of the joint 32*e*.

The electronic sound generating system 33 includes a pickup 33*a*, an electronic circuit 33*b* and a headphone 33*c*. The pickup 33*a* is formed of piezoelectric material such as, for example, polyvinylidene fluoride, and is accommodated in the follow space 32*m*. The electric circuit 33*b* is attached to the lower surface of the first cantilever 32*c*, and is connected through a coaxial cable 33*d* to the pickup 33*a*. The pickup 33*a* converts the vibrations to digital signals representative of the vibrations, and the electronic circuit 33*b* produces the audio signals from the digital signals. The audio signals are supplied to the headphone 33*c*, and the headphone 33*c* produces the electronic sounds from the audio signals.

Figure 10:
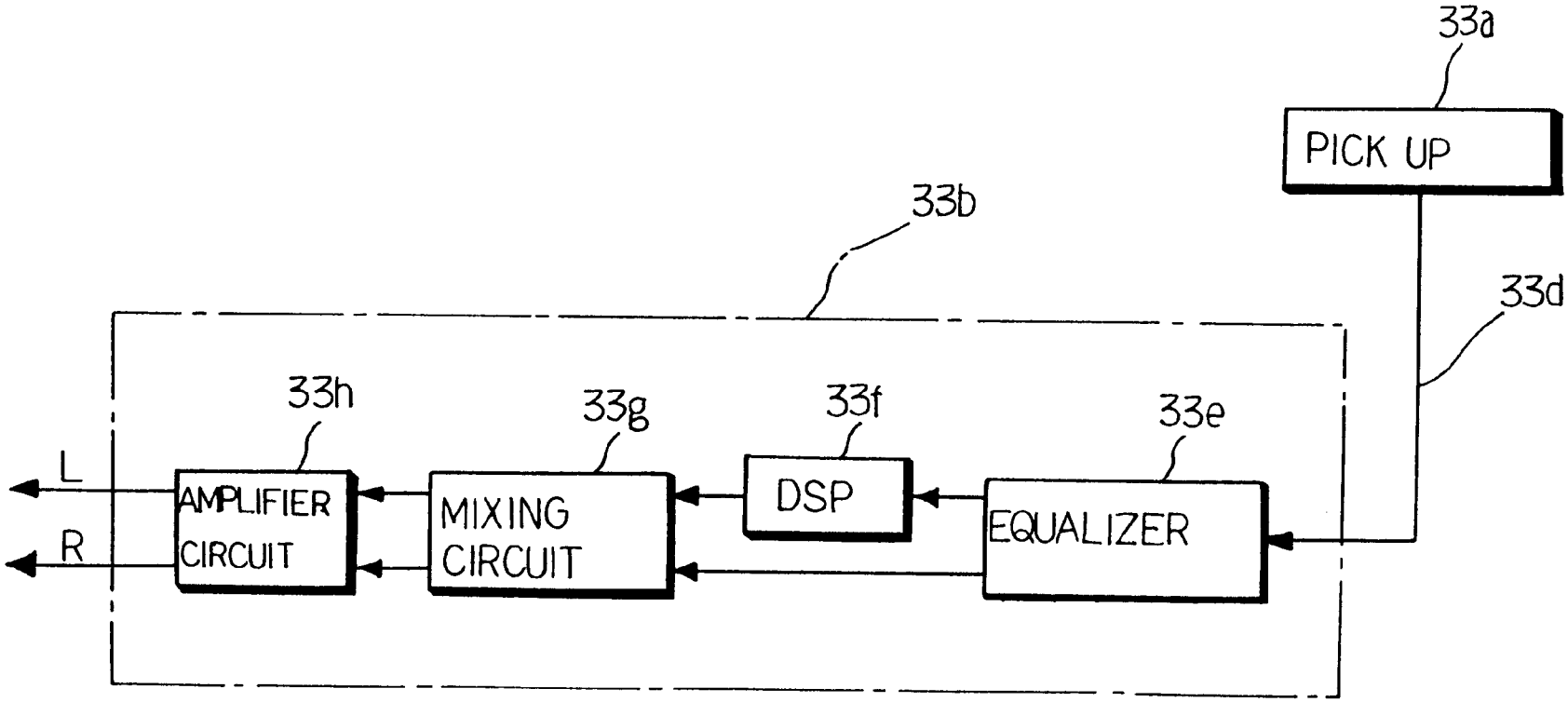
FIG. 10 is a block diagram showing the arrangement of an electronic sound generating system incorporated in the mute violin.

FIG. 10 illustrates the electronic circuit 33*b*. The electronic circuit 33*b* has an equalizer 33*e* connected to the coaxial cable 33*d*, a digital signal processor 33*f* connected to the equalizer 33*e*, a mixing circuit 33*g* connected to both of the digital signal processor 33*f* and the equalizer 33*e* and an amplifier 33*h* connected to the mixing circuit 33*h*. The equalizer 33*e* is a kind of filter. The digital signal is supplied to the equalizer 33*e*, and the equalizer 33*e* makes the frequency characteristics represented by the digital signal similar to those of violin sounds. The output signal of the equalizer 33*e* is supplied to the digital signal processor 33*f*, and the digital signal processor 33*f* produces an output signal representative of a reverb. The output signal of the equalizer 33*e* and the output signal of the digital signal processor 33*f* are supplied through the mixing circuit 33*g* to the amplifier circuit 33*h*, and the amplifier 33*h* supplies the audio signal L/R to the headphone 33*c*. The headphone 33*c* produces stereophonic electronic sounds.

The mute violin implementing the third embodiment not only reduces the acoustic violin sounds but also allows the player to personally hear them through the headphone 33*c*.

The bypass member 12*m* may be inserted between the joint 32*e* and the soundboard 11*a*. In the above described embodiments, the soundboard 11*a*, the neck 11*b*, the fingerboard 11*c*, the pegs 11*f* and the string holder 11*g* as a whole constitute a body. The neck 11*b*, the fingerboard 11*c* and said pegs 11*f* form in combination a pitch changing plate.

Although particular embodiments of the present invention have been shown and described, it will be obvious to those skilled in the art that various changes and modifications may be made without departing from the spirit and scope of the present invention. For example, only one of the supporting member and the bridge may be formed of the material exhibiting the damping characteristics.

The bridge 12*b* is inserted between the strings 11*h* and the supporting member 12*a*. For this reason, the bridge 12*b* is easily replaced with another bridge different in damping characteristics from the bridge 12*b*. If plural bridges different in damping characteristics are prepared, the violinist selects one of them so as to find appropriate loudness.

The supporting member 12*a* may have a pocket portion in which the rear end portion of the fingerboard is inserted. In this instance, a violinist easily replaces the damping bridge structure 12*b* with the standard bridge. Of course, when a standard acoustic violin is remodeled to the mute acoustic violin by using the damping bridge structure.

The present invention is applicable to any stringed musical instrument such as, for example, a viola and a cello in so far as the stringed musical instrument has a bridge between the soundboard and the strings.

The pickup 33*a* may be attached to the free end of the supporting member 22*a*. In this instance, the pickup 33*a* may be integrated with the electronic circuit 33*b*.

What is claimed is:

1. A mute stringed musical instrument comprising an acoustic stringed musical instrument including a body formed with a resonator for increasing a loudness of an acoustic sound and at least one vibratory string stretched over said body so that a player presses said at least one vibratory string against said body for changing a pitch of said acoustic sound, and a damping bridge structure provided between said body and said at least one vibratory string, including a bridge provided over said body and a damper provided under said bridge, and having damping characteristics for decreasing an amplitude of vibrations during propagation of said vibrations from said at least one vibratory string to said body.

2. The mute stringed musical instrument as set forth in claim 1, in which said body includes a soundboard having said resonator, a fingerboard projecting from one end of said soundboard and causing said player to press said at lest one vibratory string thereagainst and a string holder attached to the other end of said soundboard so that said at least one vibratory string is stretched between one end of said fingerboard and said string holder, and said damping bridge structure is supported by at least one of said fingerboard and said string holder in a spacing relation to said soundboard.

3. The mute stringed musical instrument as set forth in claim 2, in which said damper is formed of a first material having damping characteristics and connected between said fingerboard and said string holder in such a manner as to extend over said soundboard in a spacing relation thereto, and said bridge is inserted between said damper and said at lest one vibratory string so as to impart a tension to said at least one vibratory string.

4. The mute stringed musical instrument as set forth in claim 3, in which said first material is viscoelastic polymer.

5. A mute stringed musical instrument comprising an acoustic stringed musical instrument including a body formed with a resonator for increasing a loudness of an acoustic sound and at least one vibratory string stretched over said body so that a player presses said at least one vibratory string against said body for changing a pitch of said acoustic sound, said body including a soundboard having said resonator, a fingerboard projecting from one end of said soundboard and causing said player to press said at least one vibratory string thereagainst and a string holder attached to the other end of said soundboard so that said at least one vibratory string is stretched between one end of said fingerboard and said string holder, and a damping bridge structure provided between said body and said at least one vibratory string, and having damping characteristics for decreasing an amplitude of vibrations during propagation of said vibrations from said at least one vibratory string to said body, said damping bridge structure being supported by at least one of said fingerboard and said string holder in a spacing relation to said soundboard and including a supporting member formed of a first material having damping characteristics and being connected between said fingerboard and said string holder in such a manner as to extend over said soundboard in a spacing relation thereto, a bypass member inserted between said damper and said soundboard, and a bridge inserted between said supporting member and said at least one vibratory string so as to impart a tension to said at least one vibratory string.

6. The mute stringed musical instrument as set forth in claim 5, in which said bypass member is one of a set of bypass members having different damping characteristics for modifying the timbre and loudness of said acoustic sound.

7. A mute stringed musical instrument comprising an acoustic stringed musical instrument including a body formed with a resonator for increasing a loudness of an acoustic sound and at least one vibratory string stretched over said body so that a player presses said at least one vibratory string against said body for changing a pitch of said acoustic sound, said body including a soundboard having said resonator, a fingerboard projecting from one end of said soundboard and causing said player to press said at least one vibratory string thereagainst and a string holder attached to the other end of said soundboard so that said at least one vibratory string is stretched between one end of said fingerboard and said string holder, and a damping bridge structure provided between said body and said at least one vibratory string, and having damping characteristics for decreasing an amplitude of vibrations during propagation of said vibrations from said at least one vibratory string to said body, said damping bridge structure being supported by at least one of said fingerboard and said string holder in a spacing relation to said soundboard and including a supporting member formed of a first material having damping characteristics and is connected between said fingerboard and said string holder in such a manner as to extend over said soundboard in a spacing relation thereto, and a bridge inserted between said supporting member and said at least one vibratory string so as to impart a tension to said at least one vibratory string, said bridge being formed of a second material having damping characteristics.

8. A mute stringed musical instrument comprising an acoustic stringed musical instrument including a body formed with a resonator for increasing a loudness of an acoustic sound and at least one vibratory string stretched over said body so that a player presses said at least one vibratory string against said body for changing a pitch of said acoustic sound said body including a soundboard having said resonator, a fingerboard projecting from one end of said soundboard and causing said player to press said at lest one vibratory string thereagainst and a string holder attached to the other end of said soundboard so that said at least one vibratory string is stretched between one end of said fingerboard and said string holder, and a damping bridge structure provided between said body and said at least one vibratory string and having damping characteristics for decreasing an amplitude of vibrations during propagation of said vibrations from said at least one vibratory string to said body, said damping bridge structure being supported by at least one of said fingerboard and said string holder in a spacing relation to said soundboard and including a supporting member formed of a first material having damping characteristics and connected to said fingerboard in a cantilever fashion, and a bridge inserted between a free end of said fingerboard and said at least one vibratory string so as to impart a tension to said at least one vibratory string.

9. The mute stringed musical instrument as set forth in claim 8, in which said first material is viscoelastic polymer.

10. The mute stringed musical instrument as set forth in claim 9, in which said bridge is formed of a second material having damping characteristics.

11. The mute stringed musical instrument as set forth in claim 8, in which said damping bridge structure further includes a bypass member inserted between said free end of said supporting member and said soundboard.

12. The mute stringed musical instrument as set forth in claim 11, in which said bypass member is one of a set of bypass members having different damping characteristics for modifying the timbre and loudness of said acoustic sound.

13. A mute stringed musical instrument comprising an acoustic stringed musical instrument including a body formed with a resonator for increasing a loudness of an acoustic sound and at least one vibratory string stretched over said body so that a player presses said at least one vibratory string against said body for changing a pitch of said acoustic sound, a damping bridge structure provided between said body and said at least one vibratory string, and having damping characteristics for decreasing an amplitude of vibrations during propagation of said vibrations from said at least one vibratory string to said body, and an electronic sound generating system connected to said damping bridge structure for producing electronic sounds from the vibrations produced on said at least one vibratory string.

14. The mute stringed musical instrument as set forth in claim 13, in which said electronic sound generating system includes a pickup attached to said damping bridge structure for converting said vibrations propagated thereto to an electric signal, an electric circuit connected to said pickup so as to produce an audio signal from said electric signal, and a sound generator connected to said electric circuit for producing Sounds from said audio signal.

15. The mute stringed musical instrument as set forth in claim 13, in which said body includes a soundboard having said resonator, a fingerboard projecting from one end of said soundboard and causing said player to press said at least one vibratory string thereagainst and a string holder attached to the other end of said soundboard so that said at least one vibratory string is stretched between one end of said fingerboard and said string holder, and said damping bridge structure is supported by at least one of said fingerboard and said string holder in a spacing relation to said soundboard.

16. The mute stringed musical instrument as set forth in claim 14, in which said damping bridge structure includes a supporting member formed of a first material having damping characteristics and connected between said fingerboard and said string holder in such a manner as to extend over said soundboard, a receiver inserted into said supporting member at an intermediate position and connected to said pickup, and a bridge inserted between said receiver and said at least one vibratory string so as to impart a tension to said at least one vibratory string.

17. The mute stringed musical instrument as set forth in claim 15, in which said damping bridge structure further includes a bypass member inserted between said receiver and said soundboard.

18. The mute stringed musical instrument as set forth in claim 16, in which said bypass member is one of a set of bypass members having different damping characteristics for modifying the timbre and loudness of said acoustic sound.

19. A mute stringed musical instrument comprising an acoustic stringed musical instrument including a soundboard formed with a resonator for increasing a loudness of an acoustic sound, a fingerboard projecting form one end of said soundboard, a string holder attached to the other end of said soundboard, and at least one vibratory string stretched between one end of said fingerboard and said string holder in a spacing relation to said soundboard so that a player presses said at least one vibratory string against said fingerboard for changing a pitch of said acoustic sound, and a damping bridge structure supported by at least one of said fingerboard and said string holder including a bridge provided over said body and a damper provided under said bridge, for imparting a tension to said at least one vibratory string and having damping characteristics for decreasing an amplitude of vibrations during propagation of said vibrations from said at least one vibratory string to said at least one of said fingerboard and said string holder.

* * * * *